United States Patent [19]

Chung et al.

[11] Patent Number: 4,828,760

[45] Date of Patent: May 9, 1989

[54] METHOD OF CLEANING A SPENT FUEL ASSEMBLY

[75] Inventors: Dong K. Chung, Chatsworth; Charles E. Jones, Jr., Northridge, both of Calif.

[73] Assignee: Rockwell International Corporation, El Segundo, Calif.

[21] Appl. No.: 153,548

[22] Filed: Feb. 8, 1988

Related U.S. Application Data

[63] Continuation-in-part of Ser. No. 23,321, Mar. 9, 1987, abandoned.

[51] Int. Cl.[4] ..... G21C 19/48; B08B 9/02

[52] U.S. Cl. ..... 252/627; 252/626; 376/310; 34/15; 134/22.15; 134/30; 134/21

[58] Field of Search ..... 376/310, 312; 252/626, 252/627; 134/21, 30, 31, 19, 42, 22.15; 34/15

[56] References Cited

U.S. PATENT DOCUMENTS 3,479,679 11/1969 Vogel ..... 134/21 X
4,141,373 2/1979 Kartanson et al. ..... 134/21
4,285,891 8/1981 Bray et al. ..... 376/310 X
4,621,652 11/1986 Ozawa ..... 376/310 X

FOREIGN PATENT DOCUMENTS 0029919 7/1985 Japan ..... 134/19

OTHER PUBLICATIONS

"RDT Standard Sodium Removal Processes", #RDT F5-9t, Oak Ridge National Laboratory, Apr. 1977.
Van Dievoet et al., "Sodium Evaporation in an Argon Flow", pp. 418–425, Feb. 1988.
Gabler, M. J. "In Situ Evaporative Cleaning of NDHX", #128RFT000003, Mar. 1985.

*Primary Examiner*—John S. Maples
*Attorney, Agent, or Firm*—H. Frederick Hamann; Harry B. Field; David C. Faulkner

[57] ABSTRACT

A method of cleaning a fuel assembly contaminated with a radioactive alkali metal in which the fuel assembly is subjected to heating with an inert gas followed by being placed under vacuum and finally cooled with an inert gas; the latter two steps being performed in repetitive cycles.

15 Claims, 2 Drawing Sheets

METHOD OF CLEANING A SPENT FUEL ASSEMBLY

This application is a continuation-in-part application of Ser. No. 23,321, filed Mar. 9, 1987, now abandoned.

BACKGROUND OF THE INVENTION

The present invention broadly relates to a method of cleaning a spent fuel assembly which has been removed from service in a nuclear reactor. It particularly relates to a method of cleaning such a spent fuel assembly contaminated with a radioactive alkali metal and in which the fuel assembly comprises a spent fissile material selected from the group consisting of oxides and carbides of uranium and/or plutonium or a metallic uranium/plutonium alloy.

The typical breeder reactor utilizes an alkali metal as a coolant. In operation of the reactor a primary coolant is circulated via a pump through a core of fuel assemblies and then through a heat exchanger from which thermal energy is extracted by indirect heat exchange with a secondary coolant. The primary coolant picks up a certain amount of radioactivity in passing through the core. All components in contact with this primary coolant also become contaminated with the radioactive constituents. Thus, any component in contact with such coolant after removal from service must be cleaned, not only to remove the chemically highly reactive coolant but also the radioactive coolant.

All fuel handling of spent core assemblies must be done remotely in an inert gas filled fuel handling cell or facility such as a fuel storage building or housing, until the spent core assemblies are cleaned of sodium. Thereafter, they may be handled remotely in an air filled fuel handling storage facility or stored under water.

One method utilized for cleaning such components is to wash them with an organic solvent such as alcohol or wash them with water. The disadvantage of these methods is that they produce a large volume of liquid, low-level radioactive waste with its attendant storage and disposal problems.

Another technique utilized is to heat the contaminated parts to a sufficient temperature to volatilize the alkali metal and the radioactive constituents.

It also has been proposed to place such contaminated components in a chamber maintained under a vacuum to removal alkali metal vapors and radioactive constituents.

A fuel assembly removed from a breeder reactor presents a particularly unique problem. For example, during service the cladding of some of the individual fuel pins comprising the fuel assembly could have been cracked or ruptured such that some of the alkali metal will be within the cladding of the individual pins. In addition, the spent fuel assembly, after removal from service, will continue to generate some heat generally referred to as decay heat. Thus, if the fuel assembly was placed in a vacuum the individual pins could generate sufficient heat to rupture the cladding of those pins which were still intact with the release of more radioactive material. Clearly, the use of external heating would be equally inapplicable. Obviously there is a need for a procedure uniquely adapted to the cleaning of a spent fuel assembly which has been in contact with an alkali metal coolant.

OBJECTS OF THE INVENTION

It is an object of the invention to provide a cleaning and decontamination method particularly adapted for cleaning spent fuel assemblies.

It is another object of the invention to provide a method for cleaning such fuel assemblies which is both economical and efficient in removing contaminants.

It is another object of the invention to provide such a cleaning method which can accommodate increases in temperature resulting from decay heat of the fuel assemblies.

It is another object of the invention to provide a fuel assembly cleaning method which utilizes a combination of heat and vacuum.

Still another object of the invention is to provide such a method which also produces an offgas stream free of alkali metal and radioactive contaminants such that the offgas may be reused for additional cleaning.

These and other objects of the invention will be more apparent from the drawings and following detailed description.

SUMMARY OF THE INVENTION

The present invention provides a method of decontaminating or cleaning a fuel assembly contaminated with a radioactive alkali metal. Typically, a fuel assembly comprises a plurality of elongated pressurized metallic pins or tubes containing a spent fissile material under pressure. The present invention is particularly suitable for fuel assemblies containing a fissible material selected from the group consisting of carbides and oxides of uranium and/or plutonium and which are going to be reprocessed. The method comprises a plurality of sequential steps. First, the fuel assembly is placed in a sealed chamber. A heated inert gas is passed through the chamber to heat the fuel assembly to a temperature sufficient to cause evaporation of the alkali metal but not so high as to affect the structural integrity of the individual metal pins. Thereafter the chamber is evacuated to a pressure of about less than 0.05 and preferably less than 0.005 mm of mercury and maintained at that pressure until the temperature of the fuel assembly increases to a level which could affect the structural integrity of the metal pin, typically about 1000° F. Af that time a cool, inert gas is introduced through the chamber and the fuel assemblies to reduce the temperature of the fuel assembly back to a safe level, typically about 800° C. The vacuum and cooling steps are repeated as often as required to insure removal of substantially all of the radioactive alkali metal. The decontaminated fuel assemblies may then be removed from the chamber and are suitable for water storage or shipment to a chemical reprocessing center.

In accordance with certain preferred embodiments of the invention the inert gas utilized is argon and the gases removed from the sealed chamber are passed in indirect heat exchange relationship with a coolant for the condensation and removal of any vaporized alkali metal contained therein. Typically, the coolant will be one which is inert with respect to the alkali metal, for example, alcohol or other organic liquids.

In accordance with another preferred embodiment, the gas removed from the chamber when it is being evacuated is also passed through a cryogenic trap to insure substantially complete removal of any remaining radioactive alkali metal from the gas. Typically, the alkali metal will be either sodium or a mixture of sodium and potassium.

The method of the present invention is particularly applicable for use in a fuel storage building which is maintained in an inert atmosphere and generally is located adjacent to the reactor from which the fuel assemblies are removed. In such application the inert gas within the facility may be used for the heating and cooling, and after treatment for removal of sodium or other alkali metal, may be introduced into an existing gas cleaning facility which is provided within such storage buildings.

DESCRIPTION OF A PREFERRED EMBODIMENT

The present invention provides a method of removing sodium from fuel assemblies which is uniquely suited for fuel assemblies removed from a breeder reactor. In a breeder reactor, a coolant, typically sodium, potassium or a mixture thereof, is circulated through a reactor core wherein it is heated and subsequently the heat is extracted from the coolant. The reactor core comprises an array of fuel assemblies provided with passageways for the circulation of the coolant therethrough. Each fuel assembly 14 is comprised of a plurality of elongated pressurized metallic fuel pins. The fuel pin typically is a stainless steel cylinder or tube which is sealed at each end and contains, throughout a substantialy portion of its length, fuel pellets. The outer metal portion of the pin generally is referred to as the cladding. Generally, the fuel pellet is formed from an oxide or carbide of uranium and/or plutonium, some of the uranium may be converted to plutonium during service as a result of exposure to fast neutrons.

As a result of the exposure to neutrons a high pressure fission gas is generated in each fuel pin of the fuel assembly. Because of the high pressure fission gas, the heating and cooling parameters, explained in more detail herein below, must be carefully controlled to preclude rupturing of the fuel pins during the decontamination or cleaning process.

During service, it is not uncommon for an individual fuel pin to crack or rupture such that the alkali metal coolant seeps within the metal tube. This, of cource, complicates cleaning. To reprocess the fuel from a breeder reactor, it is essential that all of the alkali metal be removed as it will have a detrimental effect on the subsequent chemical reprocessing. In addition, during service, the alkali metal becomes radioactive, which is not removed could complicate the handling and shipment of the fuel assemblies.

Generally, breeder reactor facilities include an adjacent fuel handling building or facility (also called a "cell") which is maintained under an inert atmosphere, typically argon gas. New fuel assemblies for loading into the reactor was well as spent fuel assemblies removed from the reactor, are temporarily stored in such a facility. It is an advantage of the present invention that it is particularly suited for use in such an enviroment.

Figure 1:
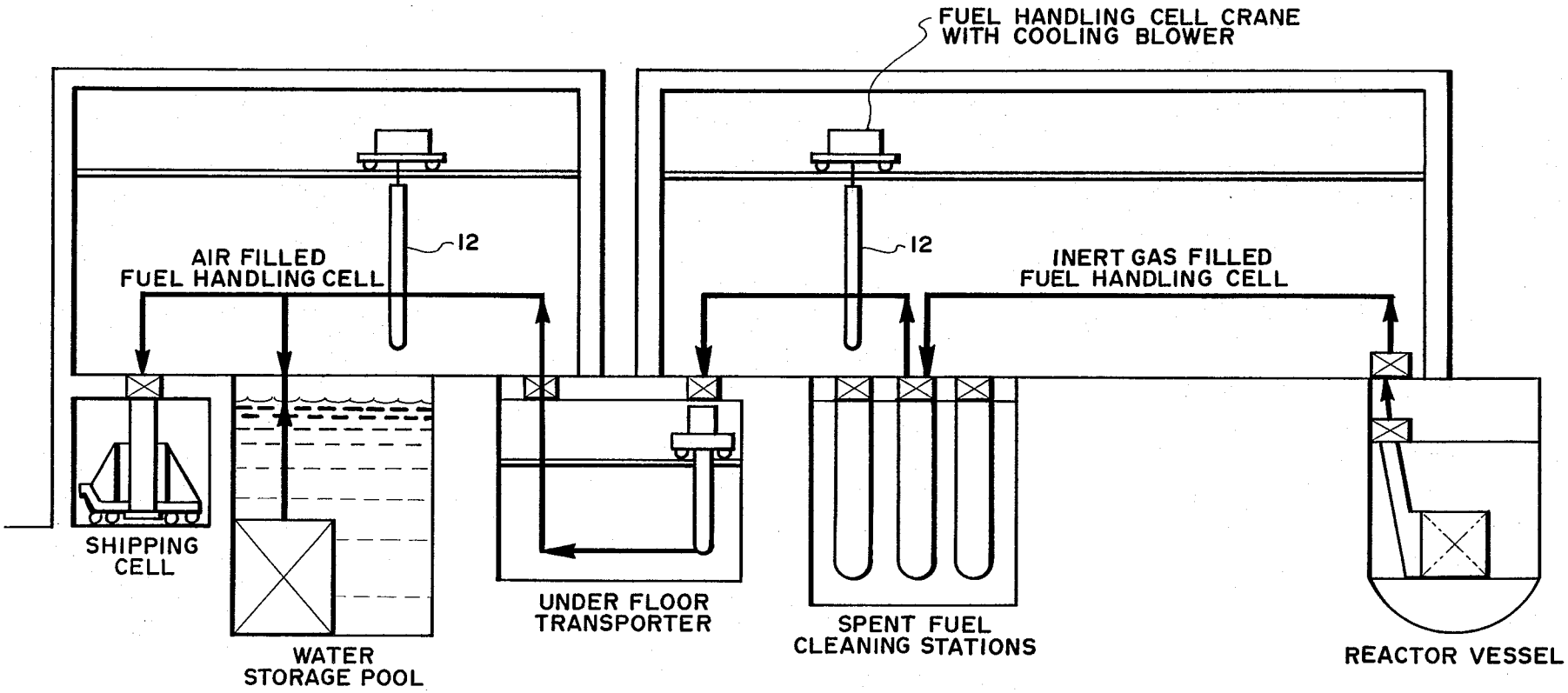
FIG. 1 is a schematic of a fuel handling system according to the present invention.

FIG. 1 shows in part a fuel storage building housing a fuel handling system for a sodium cooled breeder reactor. The spent fuel assembly is removed from the reactor into a remotely operated, inert gas filled, fuel handling cell or facility. In the cell, the fuel assembly is moved to the spent fuel cleaning device wherein the adhering alkali metal is removed from the fuel assembly outer surface. The cleaned spent fuel assembly is then transferred, via a gas lock or under floor transporter, to another remotely operated fuel handling cell or facility. The second cell may have an inert atmosphere or be air-filled, The spent fuel assembly may be stored under water to cool the fuel assembly or may be loaded into a spent fuel shipping cask for transportation to a reprocessor.

Figure 2:
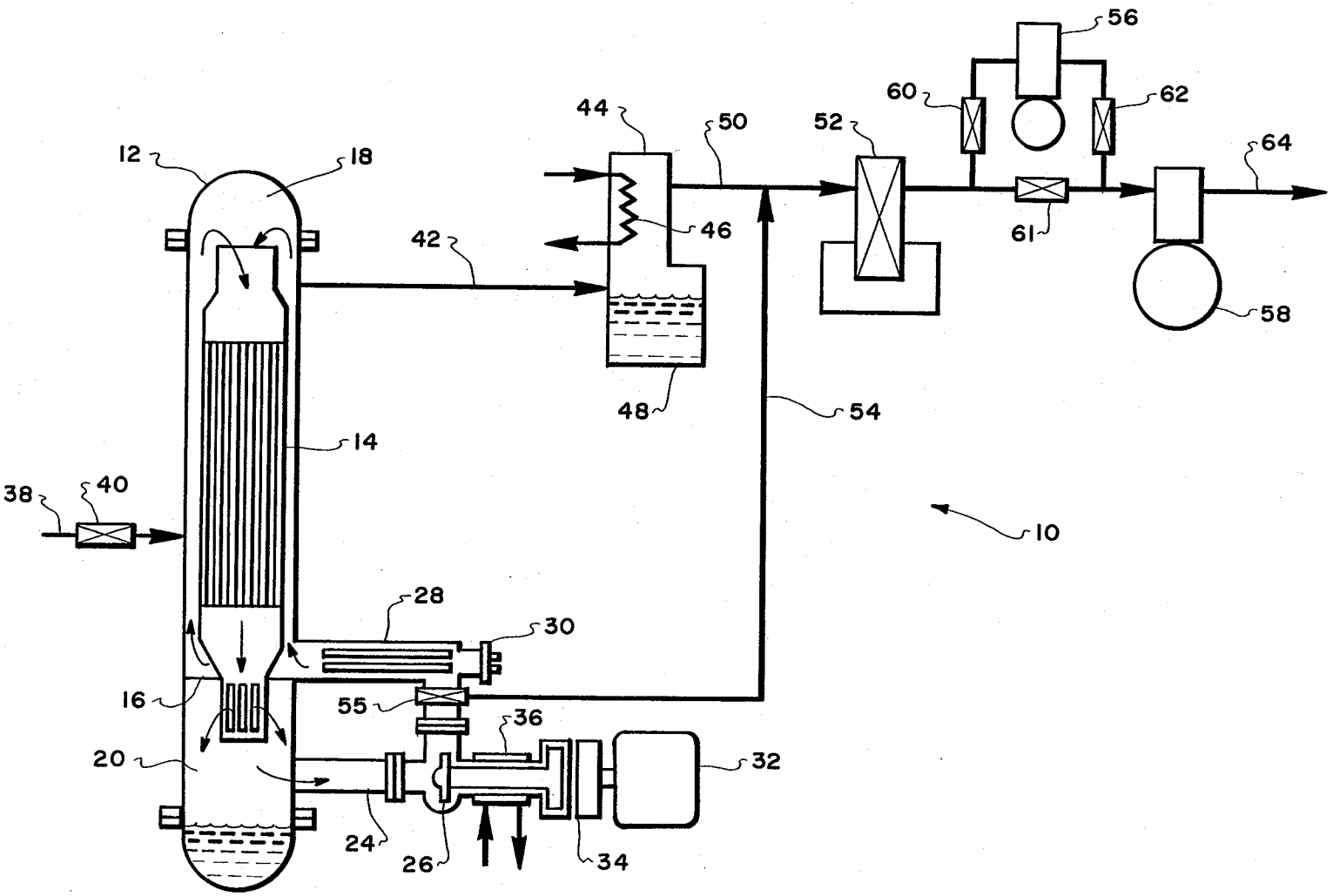
FIG. 2 is a schematic of an arrangement of apparatus for use in the practice of the present invention.

Referring now to FIG. 2, therein is depicted apparatus 10 for use in practicing the method of the present invention. The apparatus includes a sealed chamber 12 for containing a spent fuel assembly 14. Fuel assembly 14 rests on a baffle member 16 and extends therethrough. Baffle member 16 engages the outer periphery of fuel assembly 14 to insure that those gases entering an upper portion 18 of chamber 12 must flow through fuel assembly 14 and into a lower portion 20 of chamber 12. Lower portion 20 of chamber 12 is provided with a recirculation outlet conduit 24 which is in fluid communication with a blower 26 which discharges into a recirculation inlet conduit 28 through a three-way valve 55 which conduit 28 is located above baffle member 16. and communicates into chamber 12 as shown in FIG. 2. Advantageously, conduit 28 also is provided with an electrical heater 30. Blower 26 is driven by a motor 32 which is interconnected to blower 26 via a magnetic coupling 34. Typically there also will be provided some means for preventing the transfer of heat from blower 26 back to magnetic coupling 34. As depicted, this would be accomplished by a cooling jacket 36 provided with an inlet and outlet for the flow of a cooling fluid therethrough.

Chamber 12 also includes a conduit 38 and valve 40 for the introduction of an inert gas into chamber 12 in upper portion 18. Any inert gas may be used, typically the inert gas will be argon, particularly when the method of the present invention is practiced within a fuel storage or handling cell is maintained under an inert atmosphere of argon. An upper end of chamber 12 is provided with a discharge conduit 42 for conducting gas exiting upper portion 18 of chamber 12 to a condenser 44. Condenser 44 includes means for passing a coolant through an internal cooling coil 46 to condense any sodium vapors contained in the gas passing therethrough. Generally the coolant will be an organic fluid which is inert with respect to the alkali metal to prevent any reaction in the event of a leak. Condenser 44 further includes a sump portion 48 for the collection of condensed alkali metal coolant. A conduit 50 provides fluid communication between condenser 48 and a cryogenic trap 52 and also a bypass conduit 54 which connects to the three-way valve 55.

Downstream of cryogenic trap 52 are two vaccum pumps 56 and 58. Pumps 56 and 58 are in fluid communication with cryogenic trap 52 via conduits and valves 60,61 and 62. Pump 58 is also provided with a discharge conduit 64.

In accordance with the practice of the method of the present invention, a fuel assembly 14 is placed within chamber 12 which is then sealed. An inert gas, typically argon, is introduced into chamber 12 through conduit 38 and valve 40. Generally, spent fuel assembly 14 will have an initial temperature of about 400° F. (204° C.).

Power is supplied to motor 32 which drives blower 26 via magnetic coupling 34 to cause circulation of the argon from lower portion 20 of chamber 12 through conduit 24 and valve 55 and back to upper portion 18 of chamber 12 via conduit 28. Power also is supplied to electric heater 30 until the temperature of the fuel assembly is increased to about 800° F.

After the fuel assembly has been heated to a desired temperature, power to the electric heater is turned off, valve 61 is opened and vacuum pump 58 started. Typically, vacuum pump 58 will be a dry, reciprocating vacuum pump which is operated for a sufficient time to decrease the chamber pressure from atmospheric to approximately 10 mm of mercury, during which time blower 26 is maintained in operation. Thereafter, secondary vacuum pump 56 (typically an oil-sealed rotary pump) is started. Valves 60 and 62 are opened and 61 closed. The chamber pressure is then further decreased from 10 mm of mercury to at least 0.05 mm of mercury. Preferably the secondary vacuum pump 56 is operated until the pressure within chamber 12 is reduced to 0.005 mm of mercury of less. During this time, blower 26 is inoperative.

During the vacuum drying time, the gas and entrained sodium vapor is withdrawn via conduit 42 and cooled in condenser 44. Any residual sodium vapor leaving through conduit 50 is removed in cryogenic trap 52. The condensed sodium may be recovered at a later point in time. Typically, this would be accomplished in condenser 44, for example, by increasing the coolant temperature to melt the sodium and then draining it from sump 48. During the vacuum drying time, the fuel assembly temperature will continue to increase as a result of the decay heat. When the temperature reaches the maximum safe temperature for the cladding of the individual fuel pins, generally about 1000° F., the vacuum treatment is stopped.

Valves 60, 61 and 62 are closed and pumps 56 and 58 turned off. Valve 40 is open and chamber 12 is filled with argon gas to one atmosphere via conduit 38. After chamber 12 is filled with gas, valve 40 is closed and valve 55 repositioned to close conduit 28 and open conduit 54. Power is supplied to motor 32 to drive blower 26 and the argon gas is circulated through valve 55 and conduit 54 in a reverse direction through condenser 44 and back to chamber 12 via conduit 42. Typically, heater 30 would not be required for the remainder of the cleaning cycle backpressure created by the presence of heater 30 in conduit 28. The gas is circulated through chamber 12 and fuel assembly 14 until the temperature of the fuel assembly is reduced back to a desired level, typically below 800° F. The vacuum treatment and cooling are repeated as required to insure substantially complete removal of the radioactive alkali metal contaminant. The number of cycles required is readily determinable through experimentation. It will be appreciated that various other valves and instrumentation such as pressure sensors, temperature sensors, also would normally be incorporated as well as additional redundant gas cleaning techniques. However, those matters are well within the skill of those versed in the art.

The foregoing description and example illustrate a specific embodiment of the invention and what is now considered to be the best mode of practicing it. Those skilled in the art, however, will understand that changes may be made in the form of the invention without departing from its generally broad scope. Accordingly, it should be understood that within the scope of the appended claims the invention may be practiced otherwise than as is specifically illustrated and described.

What is claimed and desired to be secured by Letters Patent of the United States is:

1. A method of cleaning a fuel assembly including surfaces thereof prior to decladding, each assembly surface contaminated with a radioactive alkali metal and comprising a plurality of pressurized metallic fuel pins containing a spent fissible material, the method comprising the sequential steps of:

(a) placing the fuel assembly in a sealed chamber;

(b) passing a heated, inert gas through the chamber to heat the fuel assembly to a temperature sufficient to cause volatilization of the alkali metal but insufficient to rupture the pressurized metal pins;

(c) evacuating the chamber to a pressure of less than 0.5 mm of Hg to further enhance volatilization and removal of the alkali metal and maintaining the chamber at that pressure until the decay heat of the fissile materials causes the temperature of the fuel assembly to increase to a level which would be detrimental to the integrity of the metal pins;

(d) cooling the fuel assembly by passing a cool, inert gas through the chamber to reduce the temperature of the fuel assembly to a desired level;

(e) repeating the evacuation and cooling steps as required to insure removal of substantially all of the radioactive alkali metal from the assembly surface; and (f) recovering the cleaned fuel assembly from the chamber.

2. A method of claim 1 wherein said alkali metal is sodium.

3. A method of claim 1 wherein said alkali metal is a mixture of sodium and potassium.

4. The method of claim 1 wherein in step c) the chamber is evacuated to a pressure of less than about 0.005 mm of mercury.

5. The method of claim 1 wherein the fuel assembly free of contaminants is processed for the recovery of fissile material therefrom.

6. The method of claim 1 in which gas exiting the sealed chamber from steps c) and d) is passed in indirect heat exchange relationship with a coolant for the condensation and removal of any vaporized alkali metal therefrom.

7. The method of claim 6 wherein the gas from step c) is further conducted through a cryogenic trap to insure substantially complete removal of any remaining radioactive alkali metal from the gas.

8. A method of decontaminating a fuel assembly contaminated with a radioactive alkali metal, each fuel assembly comprising a plurality of metal pins containing a spent fissile material selected from a group consisting of carbides and oxides the method comprises the sequential steps of:

(a) placing the fuel assembly in a sealed chamber, (b) passing a heated inert argon gas through the chamber to heat the fuel assembly to a temperature of about 800° F., (c) evacuating the chamber to a pressure of less than about 0.05 mm of mercury and maintaining the fuel assembly and chamber at that pressure until the temperature of the fuel assembly is about 1000° F., (d) passing a cool inert argon gas through the chamber and the fuel assembles to reduce the temperature of the fuel assembly to about 800° F., (e) repeating steps c and d as required to ensure removal of substantially all of the radioactive alkali metal, and (f) recovering the decontaminated fuel assembly from the chamber.

9. A method of cleaning a fuel assembly including surfaces thereof prior to decladding, each assembly surface contaminated with a radioactive alkali metal and comprising a plurality of pressurized metallic fuel pins containing a spent fissible material selected from the group consisting of carbides and oxides, the method comprising the sequential steps of:

(a) placing the fuel assembly in a sealed chamber;

(b) passing a heated inert argon gas through the chamber to heat the fuel assembly to a temperature of about 800° F.;

(c) evacuating the chamber to a pressure of less than about 0.05 mm of mercury and maintaining the fuel assembly and chamber at that pressure until the temperature of the fuel assembly is about 1000° F.;

(d) passing a cool inert argon gas through the chamber and the interior of the fuel assembly to reduce the temperature of the fuel assembly to about 800° F.;

(e) repeating steps c) and d) as required to insure removal of substantially all of the radioactive alkali metal from the assembly surface; and (f) recovering the cleaned fuel assembly from the chamber.

10. The method of claim 9 in which gas exiting from the sealed chamber in steps c) and d) is passed in indirect heat exchange relatipnship with a coolant for the condensation and removal of vaporized alkali metal therefrom.

11. The method of claim 10 wherein the gas from step c) is further conducted through a cryogenic trap to insure substantially complete removal of any remaining radioactive alkali metal from the gas.

12. The method of claim 11 wherein said alkali metal is sodium.

13. The method of claim 11 wherein said alkali metal is a mixture of sodium and potassium.

14. The method of claim 11 wherein in step c) the chamber is evacuated to a pressure of less than 0.005 mm of mercury.

15. The method of claim 14 wherein the fuel assembly which is free of contaminants is processed for the recovery of fissile material therefrom.

* * * * *

UNITED STATES PATENT AND TRADEMARK OFFICE

CERTIFICATE OF CORRECTION

PATENT NO. : 4,828,760

DATED : May 9, 1989

INVENTOR(S) : Dong K. Chung; Charles E. Jones, Jr.

It is certified that error appears in the above-identified patent and that said Letters Patent is hereby corrected as shown below:

Column 7, line 10 "fissible" should read --fissile--.

Signed and Sealed this

Tenth Day of October, 1989

*Attest:*

DONALD J. QUIGG

*Attesting Officer*

*Commissioner of Patents and Trademarks*